US006637344B2

(12) United States Patent
Martin

(10) Patent No.: US 6,637,344 B2
(45) Date of Patent: Oct. 28, 2003

(54) RUNNING GEAR FOR A RAIL VEHICLE

(75) Inventor: Teichmann Martin, Graz (AT)

(73) Assignee: Siemens SGP Verkehrstechnik GmbH, Vienna (AT)

( * ) Notice: Subject to any disclaimer, the term of this patent is extended or adjusted under 35 U.S.C. 154(b) by 0 days.

(21) Appl. No.: 10/270,953

(22) Filed: Oct. 15, 2002

(65) Prior Publication Data

US 2003/0033955 A1 Feb. 20, 2003

Related U.S. Application Data

(63) Continuation of application No. PCT/AT01/00114, filed on Apr. 17, 2001.

(30) Foreign Application Priority Data

Apr. 17, 2000 (AT) ..... 680/2000

(51) Int. Cl.[7] ..... B61D 1/00
(52) U.S. Cl. ..... 105/157.1; 105/175.1
(58) Field of Search ..... 105/157.1, 159, 105/96, 96.1, 133, 136, 172, 175.1

(56) References Cited

U.S. PATENT DOCUMENTS

| | | | | | |
|---|---|---|---|---|---|
| 4,388,872 | A | * | 6/1983 | Girod et al. | 105/99 |
| 4,542,699 | A | * | 9/1985 | Smith | 105/99 |
| 4,679,506 | A | * | 7/1987 | Goding et al. | 105/136 |
| 4,787,318 | A | * | 11/1988 | Vogel | 105/136 |
| 5,520,117 | A | * | 5/1996 | Teichmann et al. | 105/139 |

* cited by examiner

*Primary Examiner*—S. Joseph Morano
*Assistant Examiner*—Robert J. McCarry, Jr.
(74) *Attorney, Agent, or Firm*—Thomas R. Vigil; Welsh & Katz, Ltd.

(57) ABSTRACT

The running gear (1) for a rail vehicle comprises at least two wheel sets (3) mounted in wheel set bearings (2). The wheel sets have axles (4), wheels (5) and a chassis frame (6). The chassis frame (6) is provided with two longitudinal sole bars (7) and with at least one cross-member (8) located therebetween and connected to the sole bars (7) via at least two articulations (9). The sole bars (7) and the cross-member (8) are movable relative to one another on a plane which is parallel to the rail plane (ε), and the wheel set bearings (2) are connected to the cross-member (8) or to one respective cross-member (8) of the rail vehicle.

16 Claims, 2 Drawing Sheets

RUNNING GEAR FOR A RAIL VEHICLE

This application is a continuation of international application number PCT AT01/00114, filed Apr. 17, 2001.

BACKGROUND OF THE INVENTION

1. Field of the Invention

The present invention relates to a running gear for a rail vehicle comprising at least two wheel sets mounted in wheel set bearings, said wheel sets having axles, wheels and a chassis frame, the chassis frame being provided with two longitudinal sole bars and with at least one cross-member located therebetween and connected to the sole bars via at least two articulations, whereby the longitudinal sole bars and the cross-member can be displaced relative to one another on a plane parallel to the rail plane.

2. Description of the Prior Art

The build of running gears with a rigid chassis frame often require complicated solutions in order to achieve the required security against derailment. This is mainly the case when such type running gears are provided with a drive. As the chassis frame is hereby usually provided with a brake suspension link and an engine console of its own, problems may arise with regard for example to the longitudinal stiffness of the chassis frame, the primary spring stiffness, and so on. Furthermore, the loads rigid chassis frames are subjected to in practical operation must be deviated by means of complicated constructions in order to achieve compliance with existing safety regulations, which may result in very high un-loaded weight of the running gear.

The above mentioned problems can be avoided hinge-linking the longitudinal sole bars and the cross-member of the chassis frame. This allows the longitudinal sole bars to align in the direction of travel when the vehicle is threading a curve for example, which reduces the chances for derailment as compared to rigid chassis frames.

Such a running gear with a H-shaped, deformable frame and consisting of two longitudinal sole bars and one cross-member is described in DE 43 06 848 A1 and in EP 0 409 128 A1. Lateral forces are thereby introduced in the chassis frame via wheel set bearings that are rigidly connected to the longitudinal sole bars.

WO 90/11216 discloses a running gear with an articulated frame provided with at least one cross-member which is arranged between two longitudinal sole bars and sprung relative to said sole bars. In this case as well, the lateral forces that may be produced by steering are introduced through wheel set bearings which are rigidly connected to the longitudinal sole bars.

In the running gears mentioned herein above, the lateral forces that may be generated when the vehicle travels around a curve are introduced into the chassis frame by way of wheel set bearings that are connected to the longitudinal sole bars of the chassis frame; said chassis frame should be capable of resisting as much as possible to deformation due to these lateral forces in order to further reduce the chances for derailment.

The disadvantage of the prior art embodiments is that they do not permit to achieve the desired stiffness to lateral forces in an articulated chassis frame on account of its design.

BRIEF SUMMARY OF THE INVENTION

It is therefore an object of the invention to provide an articulated chassis frame that is as resistant as possible to deformation due to lateral forces that may be generated when the vehicle is traveling around a curve for example.

The solution to this object is a running gear of the type mentioned herein above in which the wheel set bearings are connected to the, or to the respective one of the, cross-members of the rail vehicle.

In the running gear of the invention, the occurring lateral forces can be introduced directly into the corresponding cross-member by way of the wheel set bearings. Accordingly, the lateral forces are not introduced, like in the prior art running gears, into the longitudinal sole bars of the chassis frame. Since the cross-member is provided with a considerably higher deformation resistance to the occurring lateral loads than the longitudinal sole bars, the stiffness properties of the running gear are substantially enhanced over conventionally used running gears.

If two wheel sets having at least one cross-member arranged therebetween are provided, the wheel set bearings are configured, in an advantageous variant of the invention, to form link brackets, said link brackets being rotatable parallel to the axles of the wheel sets about prolongations of the cross-member.

A particularly good transmission of the lateral loads is achieved when the wheel set bearings are connected to the, or to the respective one of the, cross-members in such a manner that it is impossible for the wheel set bearings to get twisted relative to the corresponding cross-member about an axis normal to the rail plane.

In another advantageous embodiment the wheel set bearings are rigidly connected to the, or to the respective one of the, cross-members. An advantageous variant of this embodiment consists in providing four wheel sets, two respective wheel sets forming a pair, one cross-member being arranged between the two pairs of wheel sets. In order to achieve the best possible introduction of forces from the wheel set bearings into the cross-member in this embodiment, two wheel set bearings, located one behind the other in the direction of travel, of one respective pair of wheel sets are made in one piece.

In another variant, two wheel sets are provided, a cross-member being arranged therebetween. In this variant, a drive for the running gear may be arranged on the cross-member.

In another embodiment, each wheel set is provided with a drive for the running gear, said drive being coaxially arranged on the axles of the wheel sets.

In this embodiment it is advantageous when two consecutive drives are connected by means of two rods arranged one above the other substantially parallel to each other.

In order to relieve the wheel sets of their function of longitudinally entraining the chassis frame, it is furthermore advantageous to provide brakes in the region of the axles of the wheel sets. As a result thereof, the connection of the wheel sets with the, or the respective one of the, cross-members may be designed exclusively to achieve the required degree of lock of the wheel set about an axis normal to the rail plane. In an advantageous development of this variant, the brakes are directly connected to the drive.

In an advantageous embodiment, the wheel set bearings are arranged between the wheels.

In another variant, the wheels are arranged between the wheel set bearings.

In an advantageous embodiment of the articulations located between the cross-member and the longitudinal sole bars, the articulations are configured to form pendulum joints. The articulations are variable in height, which makes it possible to adjust the angle of inclination of a car body relative to the running gear.

In another embodiment, the articulations are configured to form ball-and-socket joints.

BRIEF DESCRIPTION OF THE SEVERAL VIEWS OF THE DRAWINGS

The present invention and further advantages thereof will be explained in closer detail in the following non restrictive description of embodiments thereof, given by way of example only with reference to the appended drawings.

DETAILED DESCRIPTION OF THE INVENTION

Figure 1:
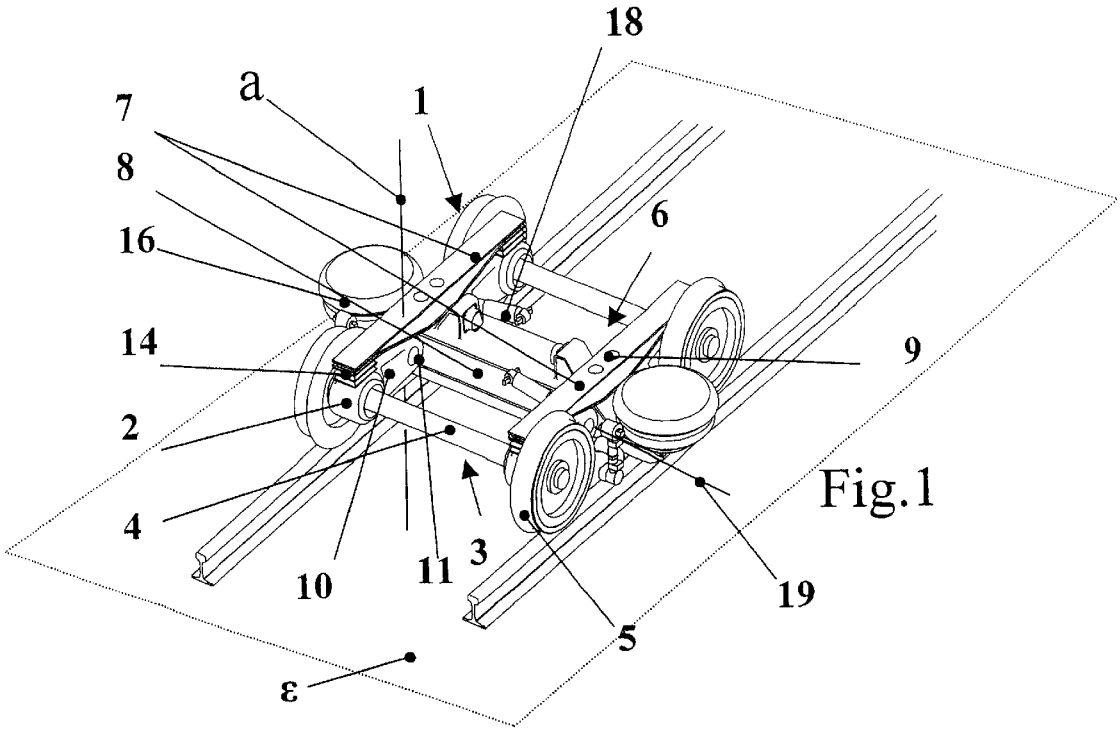
FIG. 1 is a perspective view of a running gear in accordance with the invention.

According to a first embodiment of the invention, a running gear 1 shown in FIG. 1 is comprised of at least two wheel sets 3 mounted in wheel set bearings 2, of a chassis frame 6 with two longitudinal sole bars 7 and of one cross-member 8 that connects the longitudinal sole bars 7. The members connecting the cross-member 8 and the longitudinal sole bars 7 are articulations 9. Said articulations 9 are preferably configured to form pendulum joints which are rotatably carried in bores of the longitudinal sole bars 7. The pendulum joints are adjustable in height, which permits to adjust the angle of inclination of a superstructure of the rail vehicle relative to the running gear 1. In another embodiment the joints 9 are configured to form ball-and-socket joints. Secondary springs 16 are provided to suspend the superstructure of the rail vehicle, a car body for example, relative to the running gear 1.

The wheel set bearings 2 are connected to the cross-member 8 of the rail vehicle in such a manner that they are only rotatable about an axis 19 which is parallel to the axle 4 of the wheel sets 3. Put another way, the wheel set bearings 2 cannot be rotated about an axis a which is normal to the rail plane $\epsilon$. As a result thereof, lateral forces acting on the wheels 5 can be introduced through wheel set axles 4 and the corresponding wheel set bearings 2 into the cross-member 8. With the forces being introduced in this way, it is possible to realize a running gear 1 which is particularly resistant to lateral loads. As the cross-member 8 is not capable of transmitting any torque parallel to the rail plane $\epsilon$ onto the longitudinal sole bars 7, loads acting upon it parallel to said plane cannot be transmitted to the longitudinal sole bars 7 either. Accordingly, the invention makes it possible to prevent the running gear 1 from being deformed by the occurring lateral forces. In the embodiment of the invention illustrated herein, the connections between the wheel set bearings 2 and the cross-member 8 are realized as link brackets 10 which are rotatable about prolongations 11 of cross-member 8 about axes 19 that are parallel to the axle 4 of the wheel sets 2.

Primary springs 14 are provided between the wheel set bearings 2 and the longitudinal sole bars 7, said springs having a substantial influence on the security of the running gear 1 against derailment in conventionally used running gears 1, so that they are manufactured at great expense as a result thereof. A further advantage of the invention is that the stiffness of the primary springs 14 has no influence on the security of the running gear 1 against derailment on account of the relative motion of the longitudinal sole bars 7. Accordingly, these springs are easy and inexpensive to manufacture.

Figure 2:
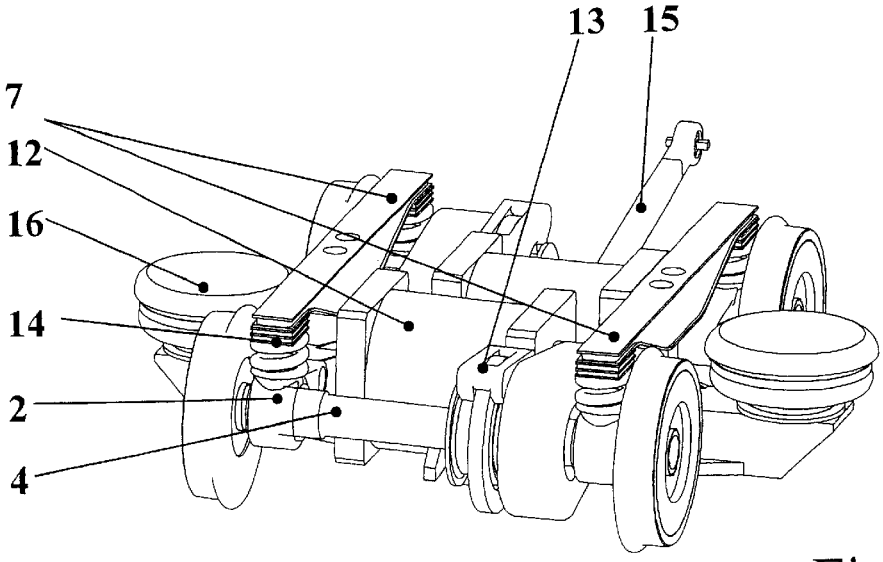
FIG. 2 is a perspective view of a running gear in accordance with the invention provided with a drive.

The variant of the invention according to FIG. 2 is provided with a drive 12 arranged in the region of the cross-member 8, the traction and compression forces being transmitted to the superstructure of the rail vehicle by way of a tension/compression rod 15 connected to the drive 12, thus forming a low traction linkage. In this embodiment such a linkage is needed to prevent the running gear 1 from being possibly jammed by nodding motions of the superstructure of the rail vehicle.

In the region of the wheel axles there are provided brakes 13 which are directly connected with drive 12. Thanks to this arrangement, braking torques act directly onto the axles 4 and can be transferred to the superstructure of the rail vehicle in the form of nodding torques by way of the tension/compression rod 15, the wheel set guides 2 being relieved of these torques as a result thereof.

Figure 3:
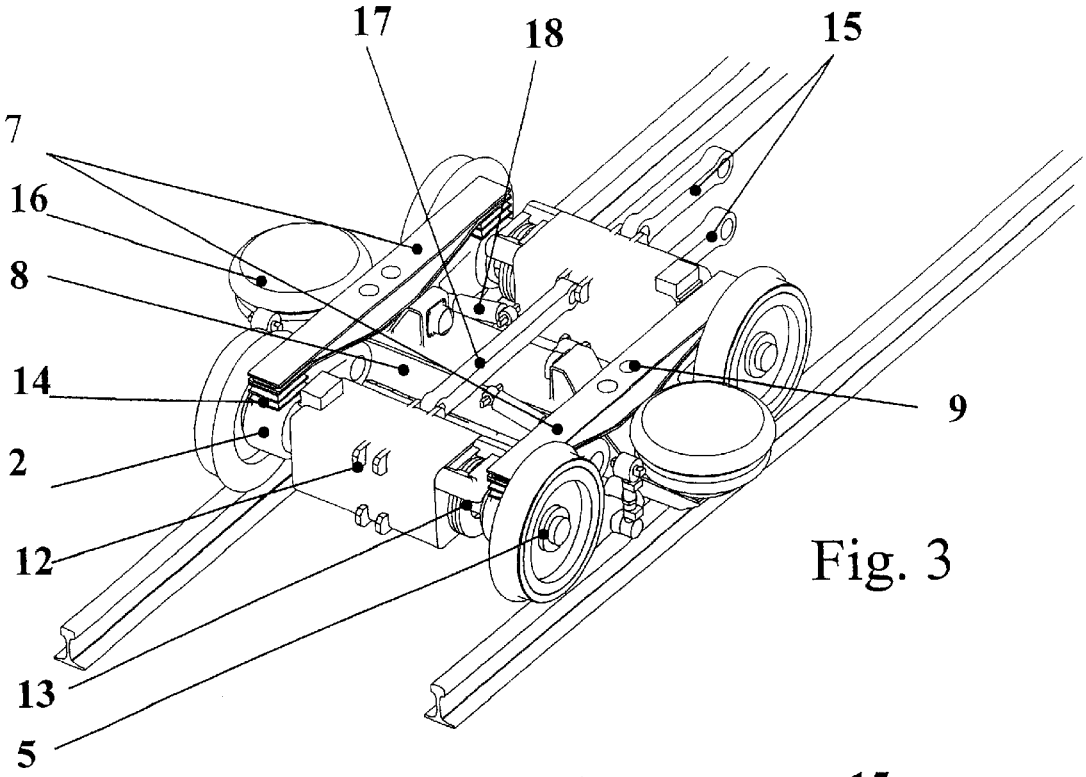
FIG. 3 is a perspective view of a running gear in accordance with the invention provided with a coaxial drive.

In another embodiment of the invention as illustrated in FIG. 3, a running gear of the invention is provided with a drive 12 in the region of each wheel axle, each drive 12 being directly connected to a brake 13. Two tension/compression rods 15, which are connected to one of the drives 12, are provided to transmit tension and compression forces.

The drives 12 are connected together by means of two rods 17 and are preferably arranged in such a manner that the longitudinal axes of the drives 12 coincide with the axles of the wheel sets so as to ensure the best possible transmission of the driving torques. One of the rods 17 joins the two drives 12 together above the cross-member 8 and the other rod 17 joins them below the cross-member 8. In this way, the number of degrees of freedom of the drives 12 is reduced by two, i.e., by one degree of rotational freedom about the wheel set axles and by one degree of translational freedom parallel to the longitudinal direction of the longitudinal sole bars 7, which permits to further reduce the load on the wheel set guides.

By transferring, as already described in connection with FIG. 2, the driving and braking torques as well as the tension and compression forces into the region of the wheel set axles, the wheel set guides 2 are relieved of their usual function of longitudinally entraining the running gear 1. Since the brakes 13 are supported through the drive 12, occurring braking and driving torques can both be transferred to the superstructure of the rail vehicle in the form of nodding torques. Accordingly, the wheel set guides 2 can be designed in the first place to comply with the necessary degree of lock of the wheel sets 3 about an axis normal to the rail plane $\epsilon$. To further cushion the running gear 1, transverse buffers 18 are provided.

Figure 4:
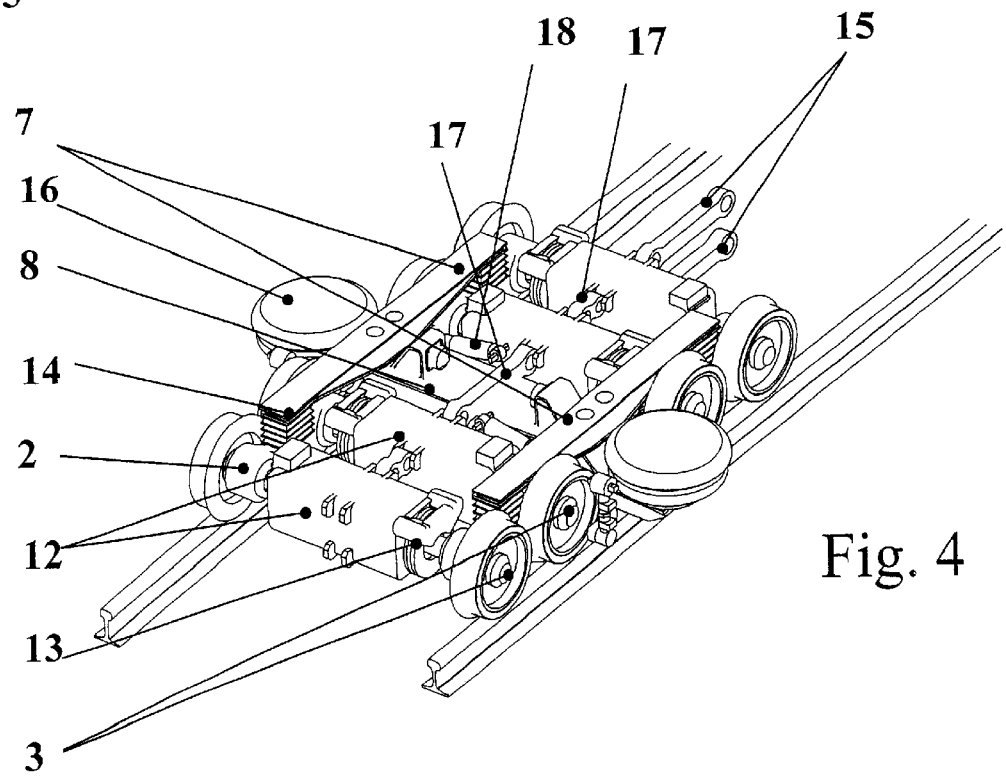
FIG. 4 is a perspective view of a running gear in accordance with the invention provided with four wheel sets.

With reference to FIG. 4, another running gear in accordance with the invention is provided with two pairs of wheel sets 3, the cross-member 8 being arranged between the pairs. In order to achieve a good introduction of forces into the cross-member 8, the two wheel set bearings 2 of one pair, which are located one behind the other, are made in one piece respectively, said piece being soldered to the cross-member 8. In the region of the axle of the wheel sets 3 drives 12 are provided, which are arranged coaxially with the wheel set axles, brakes 13, which communicate directly with the drives 12, being provided in the region of every axle as already described in the FIGS. 3 and 2. The drives 12 are joined together through rods 17, two parallel rods 17 arranged above each other joining two respective drives 12 together. In this way, the number of degrees of freedom of the drives 12 may be reduced by two, as already described in connection with FIG. 3.

In the variants of the invention illustrated in the FIGS. 1 through 4, the running gears 1 are provided with wheel sets 2 mounted outside of the chassis frame 6. However, the wheel sets 2 may as well be mounted within the chassis frame 6. Moreover, this embodiment offers the possibility of providing the running gear 1 with an aeroacoustic covering.

I claim:

1. A running gear (1) for a rail vehicle comprising at least two wheel sets (3) mounted in wheel set bearings (2), said wheel sets having axles (4), wheels (5) and a chassis frame (6), the chassis frame (6) being provided with two longitudinal sole bars (7) and with at least one cross-member (8) located therebetween and connected to the sole bars (7) via at least two articulations (9), so that, the sole bars (7) and the cross-member (8) are movable relative to one another on a plane which is parallel to the rail plane ($\epsilon$), and the wheel set bearings (2) are connected to the, or to the respective one of the, cross-members (8) of the rail vehicle.

2. The running gear according to claim 1, wherein the wheel set bearings (2) are configured to form link brackets (10), said link brackets being rotatable parallel to the axles (4) of the wheel sets (3) about prolongations (11) of the cross-member (8).

3. The running gear according to claim 1, wherein the wheel set bearings (2) are connected to the, or to the respective one of the, cross-members (8) in such a manner that it is impossible for the wheel set bearings (2) to get twisted relative to the corresponding cross-member (8) about an axis (a) normal to the rail plane ($\epsilon$).

4. The running gear according to claim 1, wherein four wheel sets (3) are provided, two respective wheel sets (3) forming a pair, one cross-member (8) being arranged between the two pairs of wheel sets (3).

5. The running gear according to claim 4, wherein two wheel set bearings (2), located one behind the other in the direction of travel, of one respective pair of wheel sets (3) are made in one piece.

6. The running gear according to claim 1, wherein two wheel sets (3) are provided, a cross-member (8) being arranged therebetween.

7. The running gear according to claim 6, wherein a drive (12) for the running gear (1) is arranged on the cross-member (8).

8. The running gear according to claim 1, wherein each wheel set (3) is provided with a drive (12) for the running gear (1), said drive being arranged coaxially with the axles (4) of the wheel sets (3).

9. The running gear according to claim 8, wherein two consecutive drives (12) are connected by means of two rods (17) arranged one above the other substantially parallel to each other.

10. The running gear according to claim 1, wherein brakes (13) are provided in the region of the axles (4) of the wheel sets (3).

11. The running gear according to claim 10, wherein the brakes (13) are directly connected to the drive (12).

12. The running gear according to claim 1, wherein the wheel set bearings (2) are arranged between the wheels (5).

13. The running gear according to claim 1, wherein the wheels (5) are arranged between the wheel set bearings (2).

14. The running gear according to claim 1, wherein the articulations (9) are configured to form pendulum joints.

15. The running gear according to claim 14, wherein the articulations (9) are variable in height.

16. The running gear according to claim 1, wherein the articulations (9) are configured to form ball-and-socket joints.

* * * * *